US006261210B1

(12) United States Patent
Lishejkov et al.

(10) Patent No.: US 6,261,210 B1
(45) Date of Patent: Jul. 17, 2001

(54) STRIKING DEVICE

(76) Inventors: Alexander Marinov Lishejkov; Cveteline Dimitrova Lishejkova, both of jk Nadejda, block 102, Ap 190, Sofia (BG), 1220

( * ) Notice: Subject to any disclaimer, the term of this patent is extended or adjusted under 35 U.S.C. 154(b) by 0 days.

(21) Appl. No.: 08/530,295

(22) PCT Filed: Oct. 14, 1993

(86) PCT No.: PCT/GB93/00013

§ 371 Date: Sep. 25, 1995

§ 102(e) Date: Sep. 25, 1995

(87) PCT Pub. No.: WO95/10336

PCT Pub. Date: Apr. 20, 1995

(51) Int. Cl.[7] ..... A63B 69/34
(52) U.S. Cl. ..... 482/83; 482/87; 482/90
(58) Field of Search ..... 428/34.1, 35.2, 428/35.4, 35.5; 482/83–90

(56) References Cited

U.S. PATENT DOCUMENTS 2,156,831 * 5/1939 Andre ..... 482/86
2,203,259 * 6/1940 Gilman ..... 482/88
3,384,372 * 5/1968 Dickens ..... 273/DIG. 5
3,421,759 * 1/1969 Chambers ..... 482/89

FOREIGN PATENT DOCUMENTS

0516092 * 12/1920 (FR) ..... 482/89

* cited by examiner

*Primary Examiner*—Jerome Donnelly

(57) ABSTRACT

A striking device for use in different kinds of fighting arts such as karate and boxing is disclosed. The device comprises an outer sack and an inner sack with a stuffing made of natural or synthetic particulate rubber. The construction of the sack renders it resistant to hard and quick hits and to repeated folding, thus extending the life of the striking device. Embodiments having different shapes and stuffing consistency are disclosed enabling training for a range of martial arts hits and strikes.

11 Claims, 4 Drawing Sheets

STRIKING DEVICE

This application is a 371 of international application, PCT/GB93/00013 filed Oct. 14, 1993.

FIELD OF THE INVENTION

The present invention concerns striking devices and in particular a karate-and-boxing sack which is intended for the training of various martial arts and fighting techniquess.

BACKGROUND OF THE INVENTION

A boxing sack comprising an outer sack of synthetic material and an inner sack with stuffing is known. The upper part of the inner sack is turned inwards in such a way that a cavity is formed in which a metal hoop is placed. The outer sack is slotted above the hoop and a wire rope passes through the slots, ends in a ring and is fixed to a support.

The disadvantages of the known sacks are as follows:

Limited applicability resulting from the lack of means for lifting and lowering and large deflection of the sack after being hit. Lack of a possibility of using the sack for lower-limb training, large deformations of the sack during hitting and short life due to the friction between the wire rope and the outer sack.

SUMMARY OF THE INVENTION

The purpose of the present invention is the creation of a karate-and-boxing sack characterized by a long life, small deformation, widened applicability, various sizes and shapes, increased weight, rigidness similar to that of the human body, capability for vertical displacement and reliable suspension.

These and other problems are solved in accordance with the present invention by means of a karate-and-boxing sack made of synthetic material in which an inner sack with stuffing is placed.

At its upper end the outer sack is turned inwards in such a way that a cavity is formed in which a metal hood is placed. According to the invention the outer sack is made of a synthetic material on polymer basis having tensile strength values of 2000–7000 N in longitudinal direction and 1500–5500 N in transversal direction.

The stuffing of the inner sack is foreseen to be on the basis of natural and/or synthetic rubber. Elastic duprene elements and rubber elements produced through the recycling of car tires are used in a preferred embodiment.

An additional layer of felt is foreseen between the outer and inner sacks. A cover fixedly connected to the inner surface of the outer sack is placed on the upper side of the inner sack. The outer sack is slotted above the hoop and straps through which a flexible element passes, are mounted to the hoop in the formed slots; the ends of said flexible element pass through a yoke and a roll mounted with displacement at a distance from the axis of the karate-and-boxing sack. At the lower outer side, of the outer sack, a ring is mounted through which another flexible element connected to a support passes.

In another optional embodiment of karate-and-boxing sack the ends of the flexible element are fixed rigidly to supports mounted laterally regarding the axis of the karate-and-boxing sack making an angle a.

In a third optional embodiment of the invention the karate-and-boxing sack is arranged horizontally and the outer sack is closed at both sides. On the upper part of the outer sack rings are mounted through which flexible elements, suspended rigidly to supports, pass.

In a fourth optional embodiment of the invention the two sacks have a pear-shaped form and the outer sack is closed at both sides. On the upper and lower parts of the outer sack rings are foreseen, through which flexible elements pass; the ends of said elements being fixedly connected to supports.

The advantages of the karate-and-boxing sack are as follows:

Long life of the karate-and-boxing sack resulting from the use of a synthetic material for the outer sack with high strength values, resistant to strong hits and multifold bending, the reliable suspension and minimal deflection when hit, the small deformability of the sack because of the stuffing. Possibility of training kicks, stable connection of the flexible element to the hoop with the help of straps which eliminates the friction between the flexible element, the hoop and the outer sack. Possibility of changing the shape and weight of the sack.

BRIEF DESCRIPTION OF THE DRAWINGS

Possible embodiments are shown in the applied figures where.

DETAILED DESCRIPTION OF THE INVENTION

Figure 1:
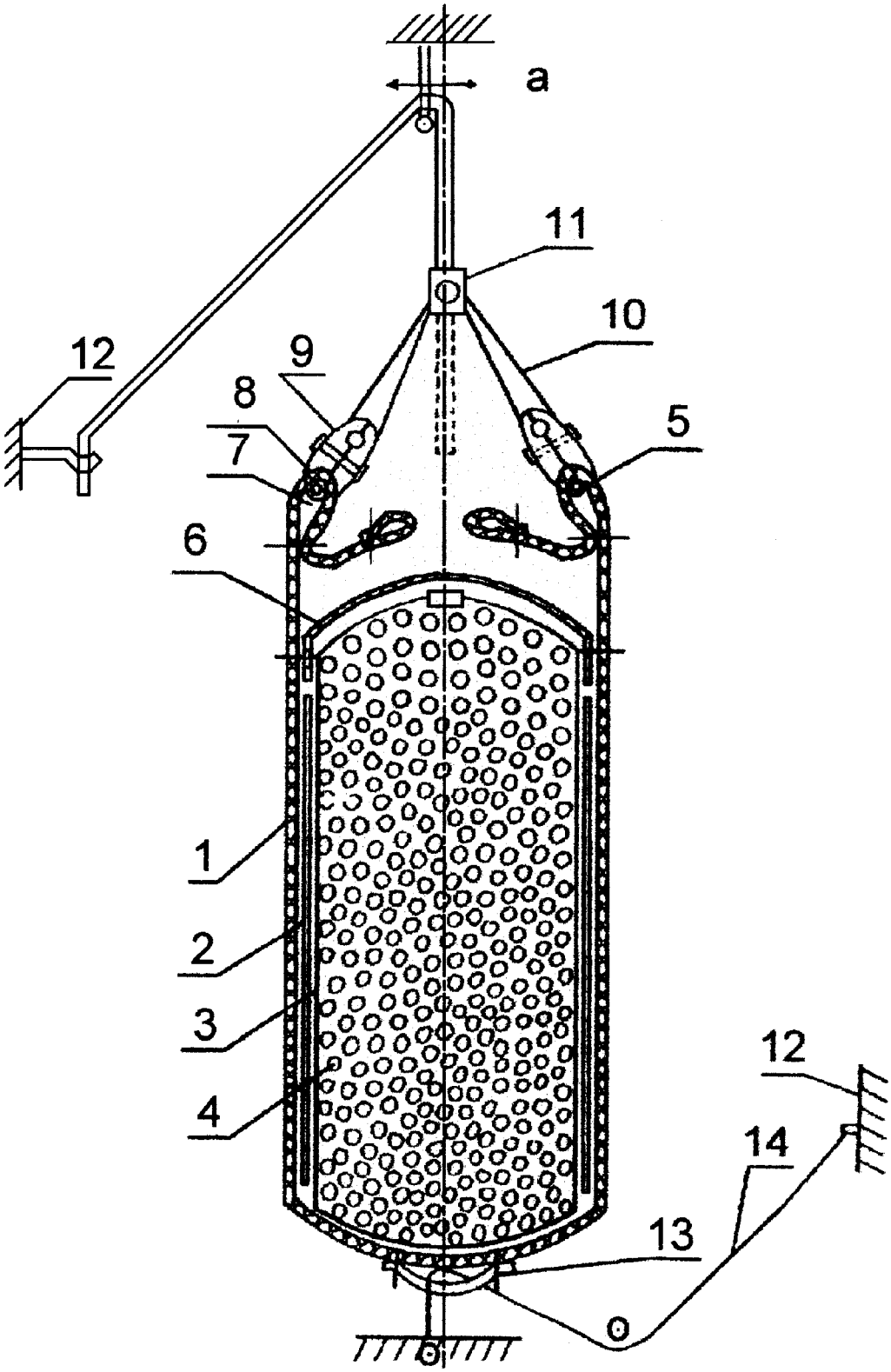
FIG. 1 illustrates a striking device in accordance with a specific embodiment of the present invention in a vertical cross-section.

The karate-and-boxing sack consists of an outer sack 1 made of synthetical material on polymer basis having tensile strength values of 2000–7000 N in longitudinal direction and 1500–5500 N in transverse direction, with folding resistance 50,000 to 90,000 times, in said sack an inner sack 3 filled with elements on the basis of natural and/or synthetic rubber 4 being placed. It is preferred to use elastic duprene elements and rubber elements produced through the recycling of car tires.

An additional layer 2 is foreseen between the outer sack 1 and the inner sack 3. A cover 6 fixedly connected to the inner surface of the outer sack 1, is placed on the upper part of the inner sack 3.

The outer sack 1 is slotted above the hoop 8 and planks 9, through which a flexible element 10 passes, are mounted in the formed slots to the hoop 8; the ends of the flexible element passing through a yoke 11 and a roll mounted with displacement at a distance regarding the axis of the karate-and-boxing sack and being fixed to a support 12. On the lower outer part of the outer sack 1 a ring 13 is mounted through which another flexible element 14 connected with support 15, passes.

Figure 2:
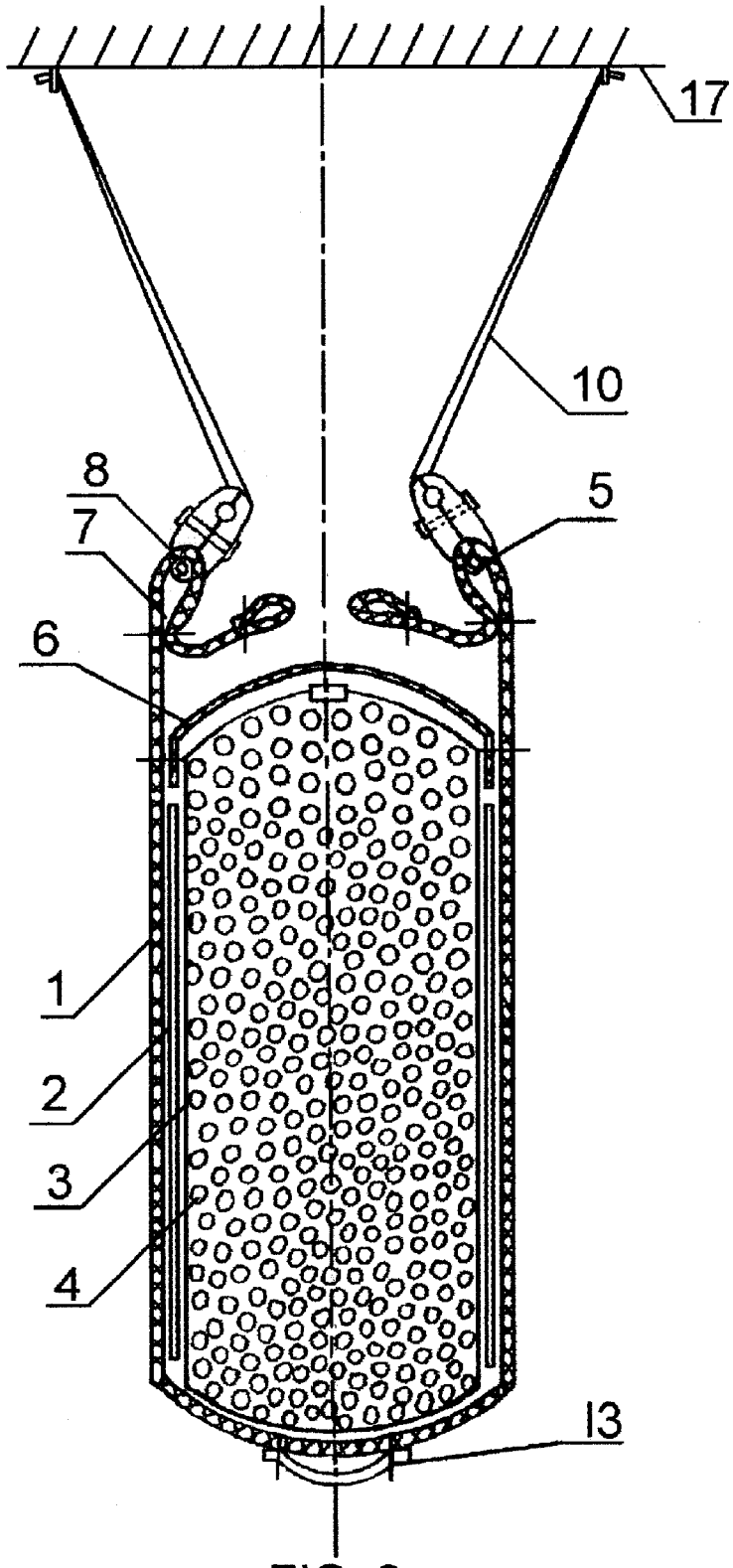
FIG. 2 illustrates in a vertical cross-section another embodiment of a striking device in accordance with the present invention.

In a second optional embodiment shown in FIG. 2 the ends of the flexible element 10 are rigidly connected to supports 17 mounted laterally regarding the axis of the karate-and-boxing sack making an angle a.

Figure 3:
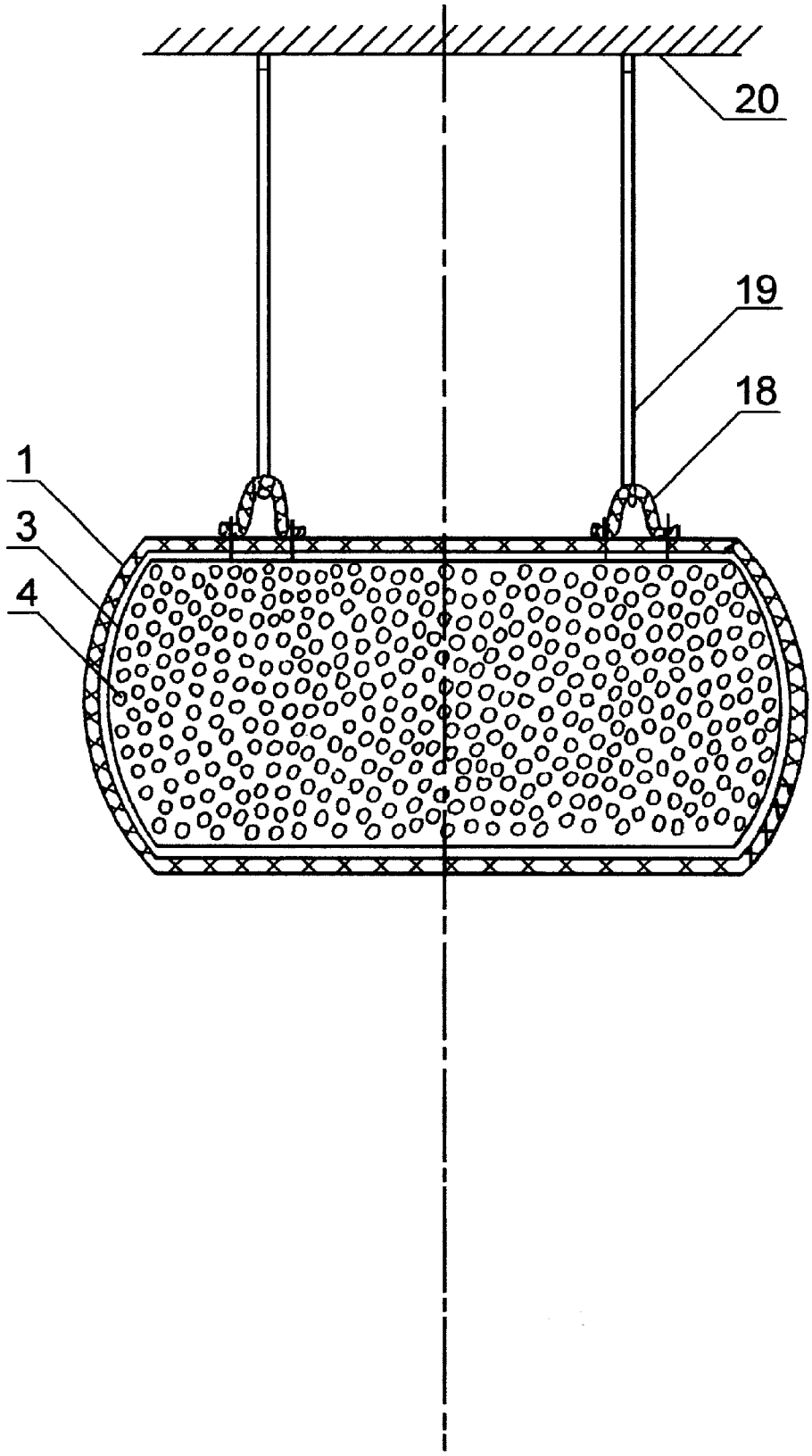
FIG. 3 illustrates another embodiment of a striking device in accordance with the present invention which is arranged horizontally.
Figure 4:
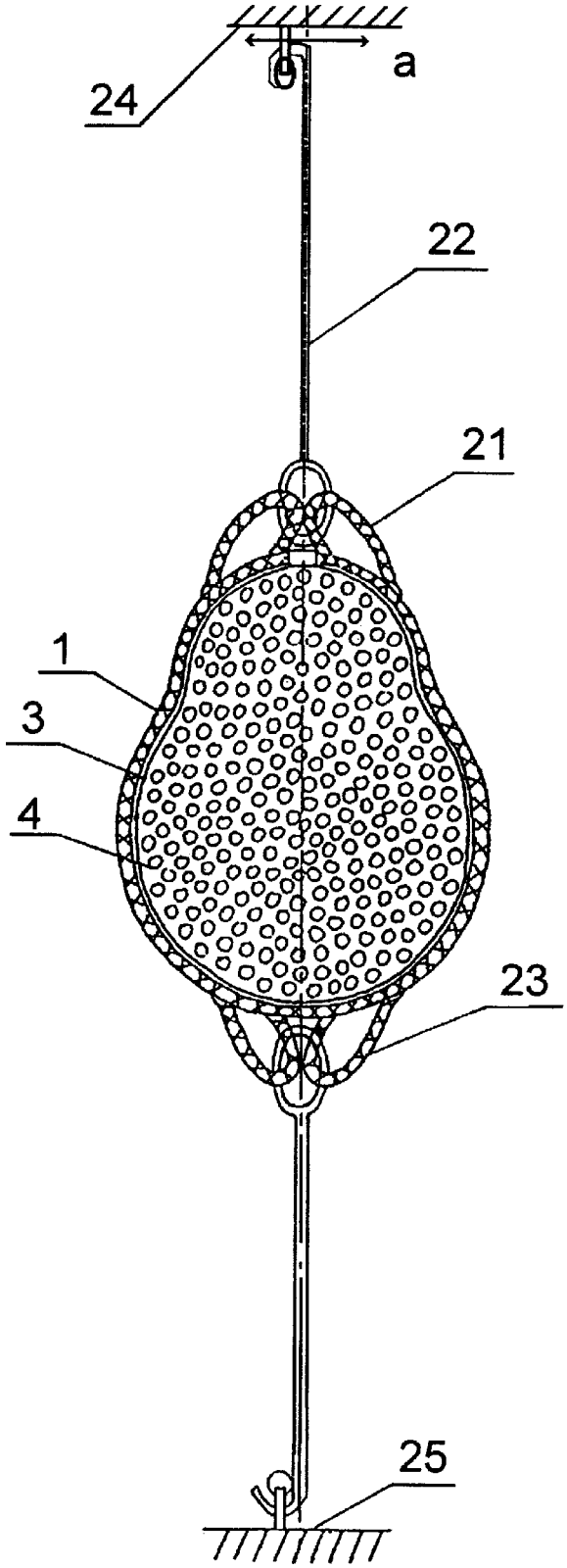
FIG. 4 illustrates another embodiment of the present invention in which the striking device has a pear-shaped form.

In a third optional embodiment of the invention shown in FIG. 3 the karate-and-boxing sack is arranged horizontally and the outer sack 1 is closed at both sides. On the upper part of the outer sack 1 rings 18 are mounted through which flexible elements 19 suspended rigidly to supports 20 pass. In a fourth optional embodiment of the invention shown in FIG. 4 the two sacks have a pear-shaped form and the outer sack 1 is closed at both sides. On the upper and lower parts of the outer sack 1, rings 21 and 23 are foreseen through which flexible elements 22 pass; the ends of said elements being fixedly connected to supports 24 and 25.

The operation of the karate-and-boxing sack is as follows:

When training high and low hits, using the flexible-element 10 the sack is adjusted at the desired height; the flexible elements 10 and 14 being lengthened or shortened and the sack being fixed to the supports 12 and 15. When the sack is fixed in this way to the supports strong and fast hits are performed and a rigidness similar to that of the human body is imitated due to the stuffing. In the second optional embodiment the rotation of the sack round its axis is eliminated through the suspension. The sack of pear-shaped form is used for high, fast and precise hits. With the horizontally arranged sack series of specific hits are performed. The various forms and suspensions of the sack enable different groups of hits to be trained under conditions similar to those in real situations.

What is claimed is:

1. A striking device comprising:

an outer sack having an upper part and a lower part, the upper part of the outer sack being folded and turned inwards to form a cavity for mounting a hoop therein and being cut to form at least two slots;

a hoop being mounted in said cavity;

an inner sack placed in said outer sack;

stuffing to fill said inner sack, said stuffing comprising particulate rubber;

an additional layer of material positioned between the outer sack and the inner sack, wherein the additional layer is made of felt; and means for attaching the device to at least one support.

2. A striking device in accordance with claim 1 wherein said means for attaching comprises: a roll for suspending the striking device from an upper support; suspension elements attached to the hoop through said of at least two slots, and a flexible connector having a first end and a second end, said first end being attached to said suspension elements, said connector passing through the roll so that pulling the second end of the connector causes the position of the striking device to change with respect to the upper support.

3. A karate-and-boxing sack in accordance with claim 1 characterized by the fact that the ends of the flexible element are mounted laterally regarding the axis of the karate-and-boxing sack making an angle a and are rigidly connected to supports.

4. A striking device in accordance with claim 2 wherein said means for attaching further comprises a fastener mounted on the lower part of the outer sack and a flexible element passing through said fastener for attaching the striking bag to a lower-end support.

5. A striking device in accordance with claim 1 wherein said stuffing comprises elastic duprene elements.

6. A striking device according to claim 4 wherein the striking device when suspended from said upper support defines an axis, and said means for attaching further comprises a first anchor element fixed to the lower support at a place substantially near the axis of the striking device; a second anchor element fixed to a side support and a roll placed away from the vertical axis, wherein said flexible element is attached to said first and second anchor elements and passes through said roll, so that when the second end of the connector is pulled the axis of the striking devices deviates from the vertical direction.

7. A striking device according to claim 1 wherein said particulate rubber is synthetic rubber.

8. A striking bag according to claim 1 wherein said particulate rubber is natural rubber.

9. A striking bag according to claim 1 wherein the rubber stuffing is made of recycled car tires.

10. The striking bag of claim 1 wherein the outer sack is made of synthetic material having tensile strength values of 2000–7000 N (62–84 MPa) in longitudinal direction and 1500 to 5500 N (60–80 MPa) in transversal direction, and folding resistance of approximately 50,000 to 90,000 times.

11. The striking bag of claim 1 wherein said stuffing has rigidness similar to that of the human body.

* * * * *